US010084277B2

(12) United States Patent
Wason et al.

(10) Patent No.: US 10,084,277 B2
(45) Date of Patent: Sep. 25, 2018

(54) IN-LINE HYDRAULIC CRIMP TOOL

(71) Applicant: Hubbell Incorporated, Shelton, CT (US)

(72) Inventors: Peter Matthew Wason, Manchester, NH (US); John Lefavour, Litchfield, NH (US)

(73) Assignee: Hubbell Incorporated, Shelton, CT (US)

( * ) Notice: Subject to any disclaimer, the term of this patent is extended or adjusted under 35 U.S.C. 154(b) by 0 days.

(21) Appl. No.: 15/584,658

(22) Filed: May 2, 2017

(65) Prior Publication Data

US 2017/0317461 A1 Nov. 2, 2017

Related U.S. Application Data

(60) Provisional application No. 62/330,598, filed on May 2, 2016.

(51) Int. Cl.

| | |
|---|---|
| ***B21J 9/18*** | (2006.01) |
| ***H01R 43/042*** | (2006.01) |
| ***B25B 27/10*** | (2006.01) |
| *B25B 28/00* | (2006.01) |

(52) U.S. Cl.

CPC ..... *H01R 43/0427* (2013.01); *B25B 27/10* (2013.01); *B25B 28/00* (2013.01)

(58) Field of Classification Search

CPC .. H01R 43/0427; H01R 43/042; B25B 28/00; B25B 27/02; B25B 27/10; B21J 9/18; B21J 9/14

USPC ..... 72/407

See application file for complete search history.

(56) References Cited

U.S. PATENT DOCUMENTS

| | | | | |
|---|---|---|---|---|
| 5,289,712 | A | 3/1994 | Haughian | |
| 7,464,578 | B2 * | 12/2008 | Ayer | B25B 27/10 60/477 |
| 2006/0272381 | A1 | 12/2006 | Ayer et al. | |
| 2007/0256554 | A1 | 11/2007 | Montminy et al. | |
| 2008/0087064 | A1 | 4/2008 | Lefavour et al. | |
| 2009/0031779 | A1 | 2/2009 | Lefavour et al. | |
| 2010/0107843 | A1 | 5/2010 | Lefavour et al. | |

OTHER PUBLICATIONS

PCT/US2017/030583 International Search Report and Written Opinion dated Sep. 14, 2017 (16 pages).

* cited by examiner

*Primary Examiner* — David B Jones
(74) *Attorney, Agent, or Firm* — Michael Best & Friedrich, LLP

(57) ABSTRACT

A crimp tool having jaw members joined in a tongue-in-groove connection held in place by a locking pin. Each jaw member being tapered and including weight reducing pockets defined in respective sidewalls. Each jaw member includes a locking tab on an outside edge that mates with a respective locking tab opening in the neck of the tool. When the locking pin is removed, the jaws of the tool separate and rotate away from one another until their respective locking tabs engage their respective locking tab opening, thereby holding the opened jaws in the neck of the tool.

19 Claims, 12 Drawing Sheets

SECTION A-A

DETAIL C

SECTION H-H

DETAIL F

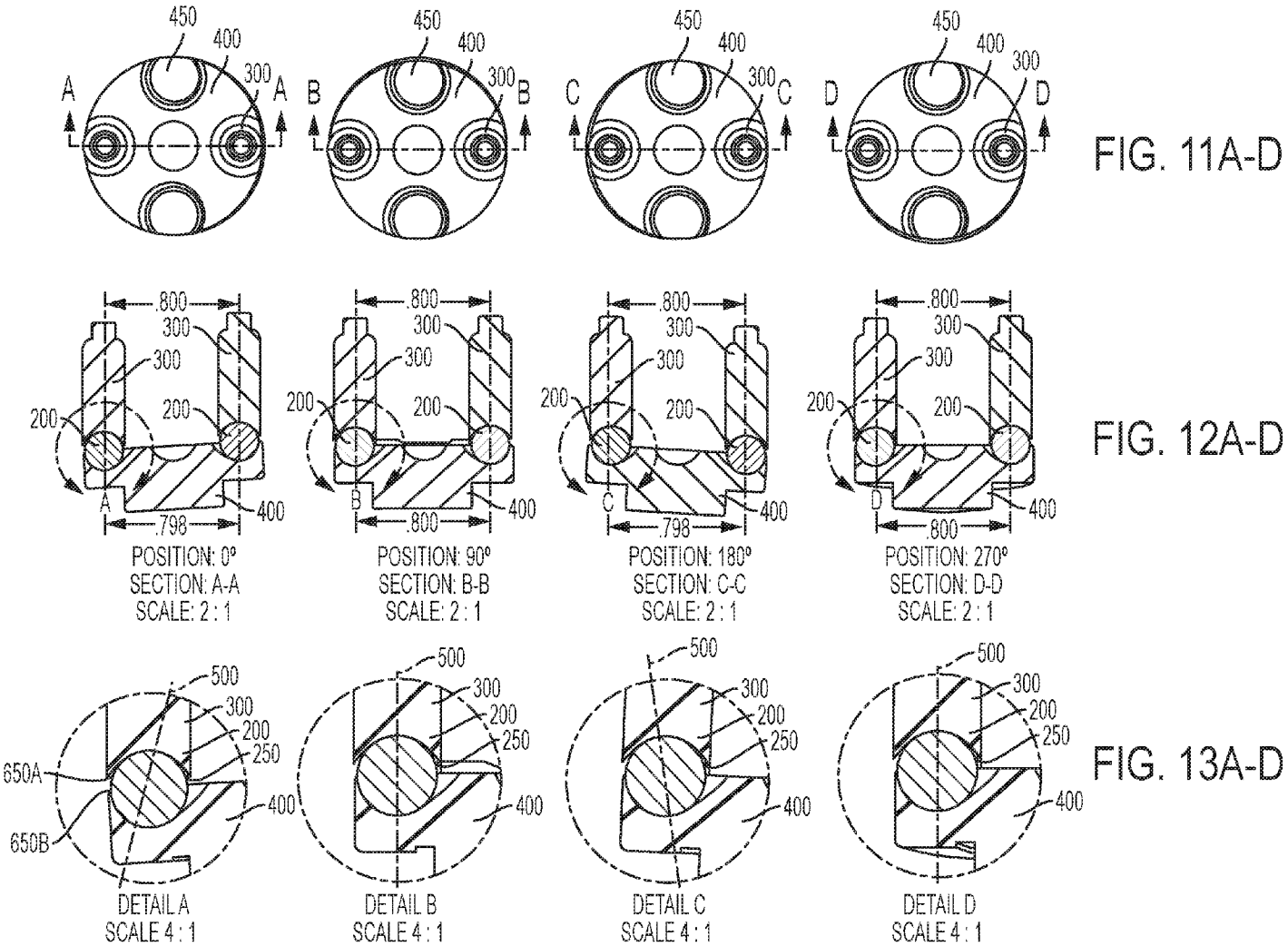
FIG. 11A-D
FIG. 12A-D
FIG. 13A-D
POSITION: 0°
SECTION: A-A
SCALE: 2 : 1
POSITION: 90°
SECTION: B-B
SCALE: 2 : 1
POSITION: 180°
SECTION: C-C
SCALE: 2 : 1
POSITION: 270°
SECTION: D-D
SCALE: 2 : 1
DETAIL A
SCALE 4 : 1
DETAIL B
SCALE 4 : 1
DETAIL C
SCALE 4 : 1
DETAIL D
SCALE 4 : 1
.800
.798
.600
200
300
400
450
500
250
650A
650B

IN-LINE HYDRAULIC CRIMP TOOL

CROSS-REFERENCE TO RELATED APPLICATIONS

This application claims the right of priority under 35 U.S.C. 119(e) to U.S. Provisional Application No. 62/330,598, filed on May 2, 2016, the entire contents of which are hereby incorporated by reference in their entirety.

FIELD OF THE INVENTION

The present invention relates to cooperating jaws and hydraulic tools having cooperating jaws. More particularly, the present invention relates to hydraulic, hand-held crimp tools and jaw heads for crimp tools.

BACKGROUND

Hand-held hydraulic tools are well known in the art. These tools use cooperating jaws that are hydraulically pressed together with great force to crimp materials. These tools may be battery-powered to allow mobility and portability for the user. These tools typically employ a locking pin that holds the jaws together for the crimping operation. The locking pin is removed to release the jaws.

Prior art crimping tools illustrative of the typical features, controls, and configurations are disclosed in U.S. Pat. Nos. 7,216,523; 7,409,846; 7,434,441; 8,336,362 to Frenken, the entire contents of which are hereby incorporated by reference.

The present inventor recognized certain perceived drawbacks with prior art hydraulic crimp tools and jaws for such crimp tools. Specifically, the inventor recognized that prior art crimp tools use hermaphroditic jaws, much like common scissors, which was perceived to result in uneven force being applied during crimping. Additionally, the present inventor recognized that inherent tolerances systemic in the bulk manufacturing of hermaphroditic jaws may adversely affect performance of the jaws in operation.

The present inventor also perceived a drawback with many prior art crimp tools in that they are difficult to manipulate by the user for various reasons. For example, as will be appreciated by one of ordinary skill in the art, when the locking pin for the jaws is removed, the jaws separate and may fall out of the tool, adding to the complexity of using the tool and interchangeable jaws/heads. The present inventor also recognized that the weight of crimp tools adversely affects the usability of these tools, as true with any tool carrying unnecessary weight. Additionally, the present inventor perceived a drawback in the casting process of hermaphroditic jaws in that there could be casting imperfections in the jaws due to uneven cooling of the metal with certain casting techniques.

As perceived by the present inventor, the foregoing highlights some of the possible problems and drawbacks with conventional hydraulic crimp tools and their jaws. Furthermore, the foregoing highlight's the present inventor's recognition of the long-felt, yet unresolved need in the art for a lighter tool and/or a tool with features that aid a user's ability to manipulate the tool without losing efficacy. In addition, the foregoing highlights the inventor's recognition of a need in the art for jaws that do not have the drawbacks of hermaphroditic jaws in manufacturing, use, and interchangeability.

SUMMARY

Various embodiments of various permutations of the features and advantages of the present invention overcome various of the aforementioned and other disadvantages associated with prior art crimp tools and jaws. The present invention is based, in part, on the discovery that modifying the jaws of a crimping tool can aid the usability of the tool. Various objects of some embodiments of the invention are based, in part, on the discovery that predetermined placement of tabs on the jaws and tab notches on the tool neck can control the positioning on the jaws in an advantageous position. Other objects of various embodiments of the present invention are based, in part, on the discovery that the jaws of a tool can be tapered to reduce the weight of the tool without compromising crimping ability while also possibly removing weakness attributable to the typical prior art casting process. Further, pockets of material can be removed to reduce the weight without sacrificing strength and allowing the jaws to handle stress in a more uniform manner across the operative area of the jaws. Still other objects of other embodiments of the present invention are based, in part, on the discovery that the use of a tongue-and-groove arrangement of the jaws may be advantageous over hermaphaditic jaws. And still other objects of various embodiments of the present invention are based, in part, on the discovery that the provision of a bushing or sleeve for the locking pin bore to hold the jaws together after removal of the locking pin and for facilitating ease of entry and removal of the locking pin.

As discussed herein, the present inventor conceived of a tongue-and-groove arrangement of the jaws of a crimping tool to ensure the forces acting on the jaws during operation and use are symmetrical. The present inventor also conceived of the use of a sleeve or bushing in the locking pin opening to hold the tool jaws in place when the locking pin is removed as well as provide a smooth, uninterrupted surface for ease of inserting and removing the locking pin.

The present inventor also conceived of the use of tabs at the back end of the jaws to serve as stops to hold the jaws open. Preferably, the neck of the tool includes tab slots for receiving the tabs and holding the jaws in a desired position. Preferably, the tabs and notches are positioned to align the pivot hole with the jaw release pin to allow the rollers to contact the cam surfaces of the jaws.

The present inventor also conceived of ways to reduce the weight of the tool without compromising the strength of the tool. The present inventor conceived of improvements in the shape of the tool's jaws to maximize strength, reduce imperfections during casting, and at the same time reduce overall weight. The jaws can be tapered to reduce the weight of the tool without compromising crimping ability while also possibly removing weakness attributable to the typical prior art casting process. Further, pockets of material can be removed to reduce the weight without sacrificing strength and also providing the benefit of allowing the jaws to handle stress in a more uniform manner across the operative area of the jaws.

The various advantages aspects and features of the various embodiments of the invention described and claimed herein should become evident to a person of ordinary skill in the art given the following enabling description and drawings. The aspects and features disclosed herein believed to be novel and other elements characteristic of the various embodiments of the invention are set forth with particularity in the appended claims. The drawings are for illustration purposes only and are not drawn to scale unless otherwise indicated. The drawings are not intended to limit the scope of the invention despite depicting a presently preferred embodiment of the invention. The following enabling disclosure is directed to one of ordinary sill in the art and presupposes that those aspects of the invention within the ability of the ordinarily skilled artisan are understood and appreciated.

As used in this application, the terms "front," "rear," "upper," "lower," "upwardly," "downwardly," and other orientational descriptors are intended to facilitate the description of the exemplary embodiment described herein, and are not intended to limit the structure of the exemplary embodiments or limit the claims to any particular position or orientation.

BRIEF DESCRIPTION OF THE DRAWINGS

The advantageous aspects and features of various exemplary embodiments will be more apparent from the description of those exemplary embodiments taken with reference to the accompanying drawings, in which:

FIG. 11A-D is a top view of a wobble plate assembly according to an embodiment of the invention.

FIG. 12A-D is a cross-sectional side view of the wobble plate assembly of FIG. 11A-D taken along lines A-A, B-B, C-C, and D-D, respectively.

FIG. 13A-D is close up of the wobble plate assembly of FIG. 12A-D of the features shown in circles A, B, C, and D, respectively.

DESCRIPTION OF THE PREFERRED EMBODIMENTS

While the present invention will be shown and described in connection with a battery-powered, hand-held crimp tool, one of ordinary skill in the art armed with the present application will readily appreciate that the inventive concepts and aspects of the invention may be implemented in a wide variety of tools, fields, and uses. The present invention should not be deemed to be limited to the embodiments that are described herein.

Figure 1:
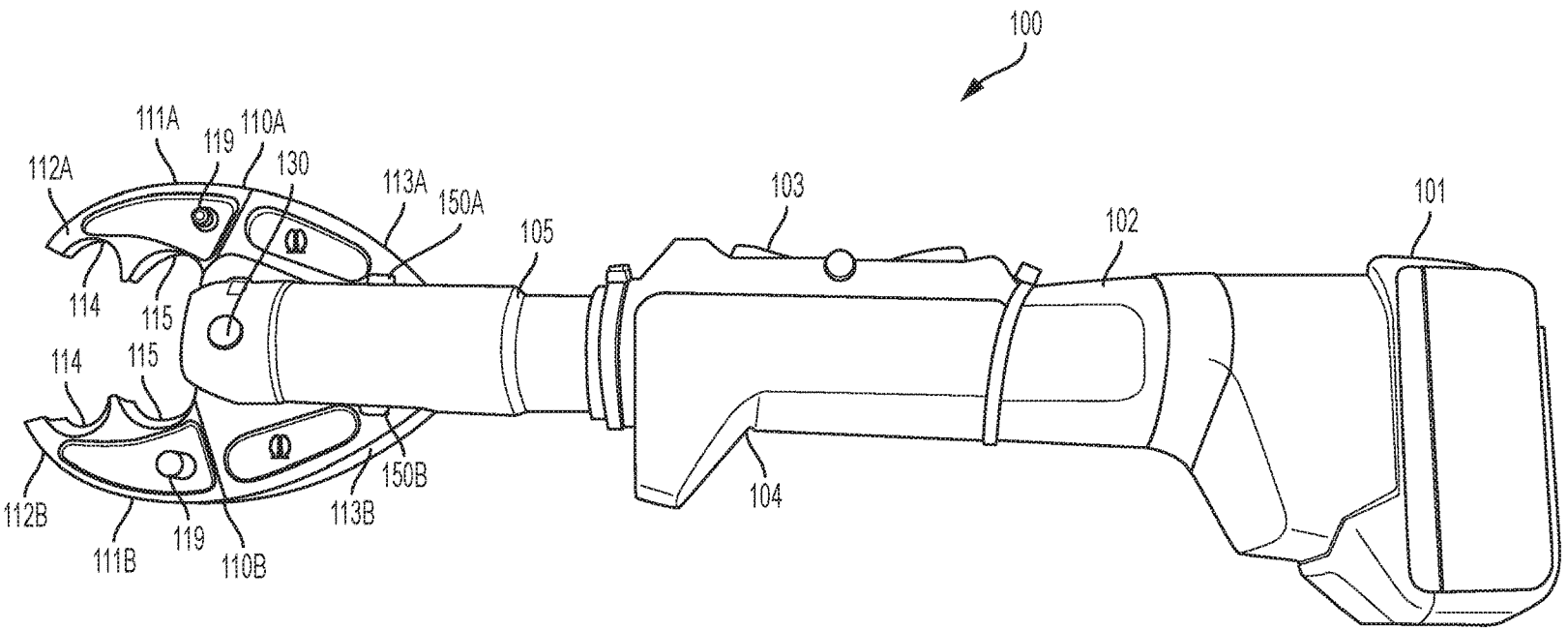
FIG. 1 is a side view of a battery-powered crimp tool embodiment according to various aspects of the present invention.

As shown in FIG. 1, a battery-powered crimp tool 100 includes a battery pack 101, a handle portion 102 that houses the controls 103 and a hand grip 104, a neck portion 105, and a pair of cooperating jaw members 110A, 110B.

Figure 2:
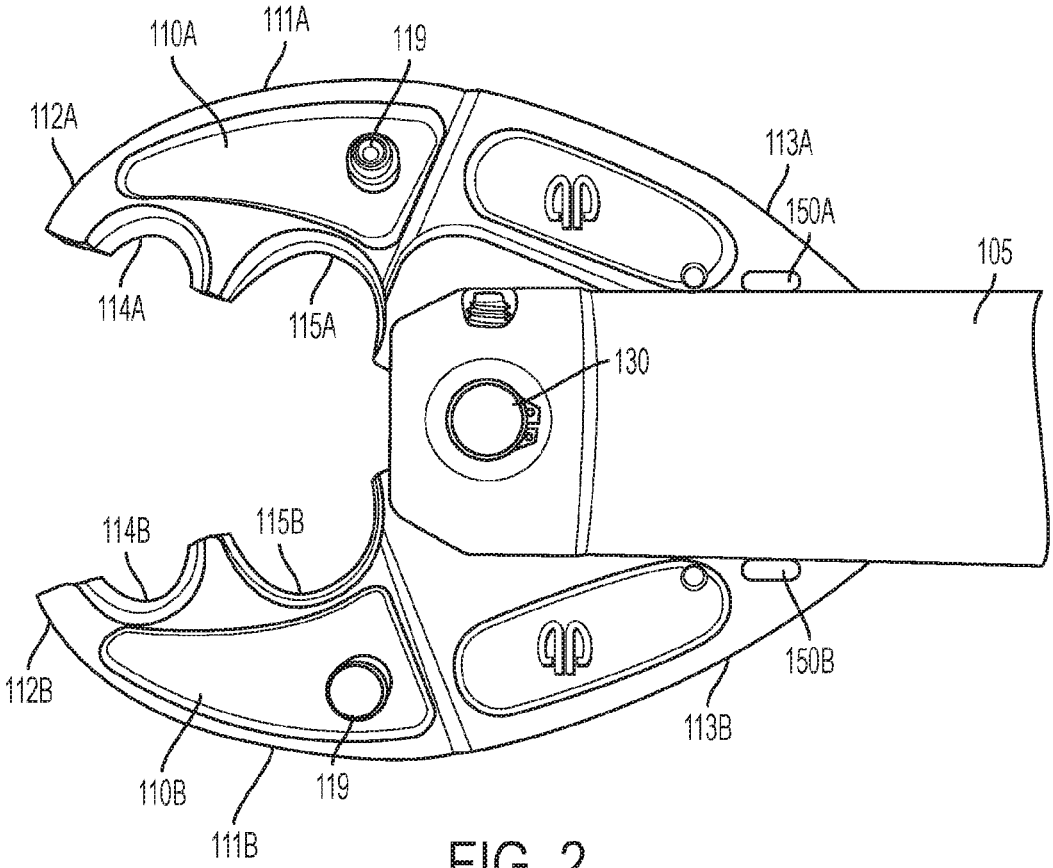
FIG. 2 is side view of the jaws of the crimp tool of FIG. 1 in the open position.
Figure 3A:
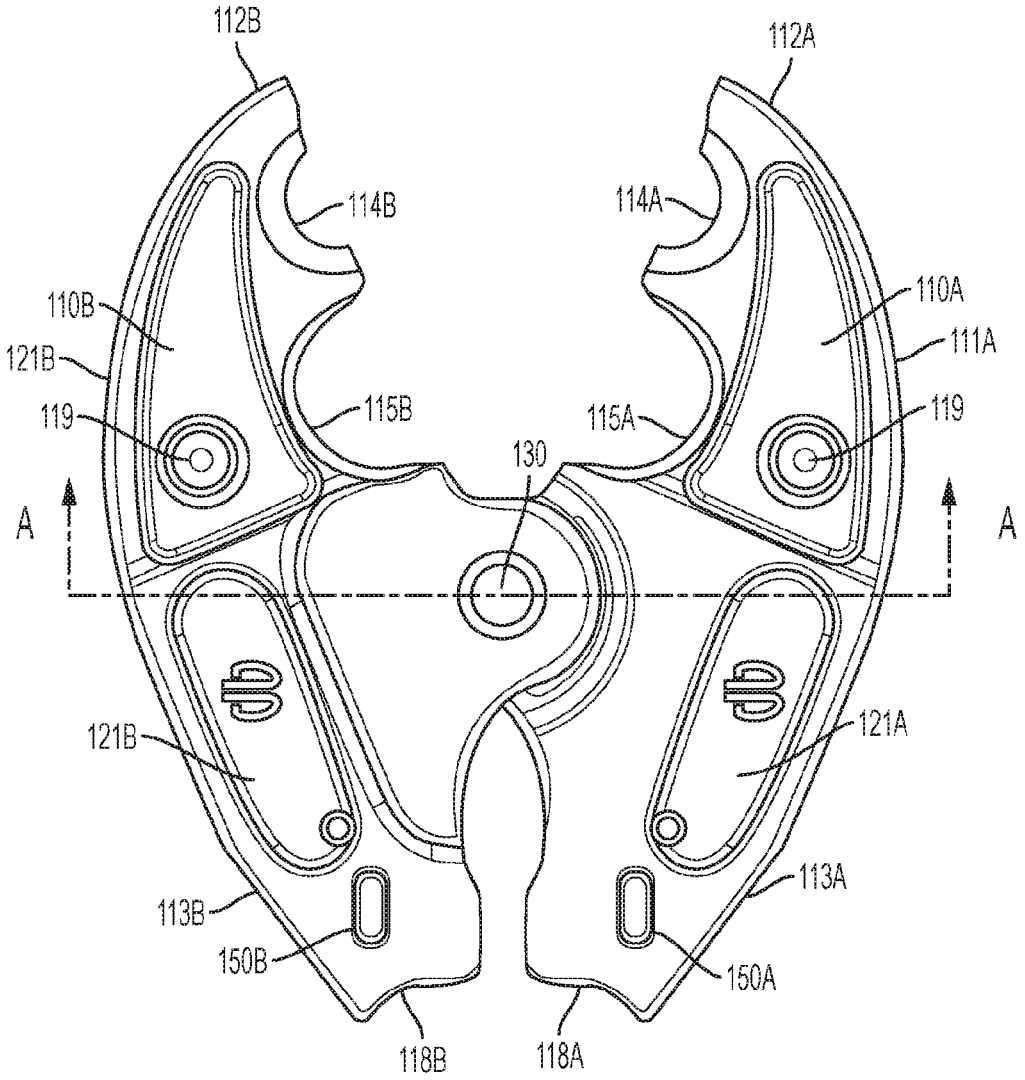
FIG. 3A is a cross-sectional view of the jaws of an embodiment of the present invention.
Figure 3B:
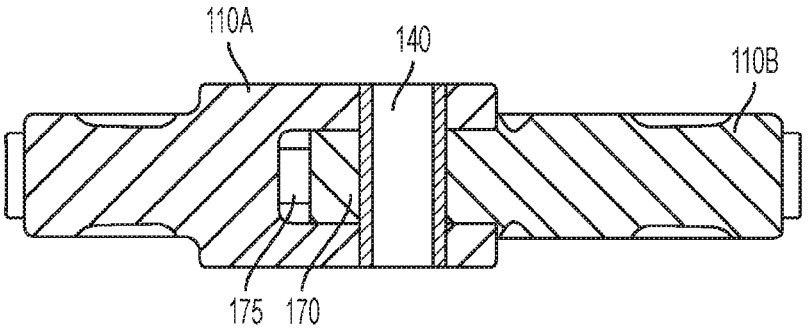
FIG. 3B is a cross-sectional top view of the jaws of FIG. 3A taken along line A-A.

As best shown on FIGS. 2 and 3, each jaw member includes a curved pressing lever in having a front tip portion 112 and a back portion 113. The interior area of jaw lever defines one or more curved crimp surfaces 114, 115. In the depicted embodiment, the jaws include crimp grooves 114, 115. As will be appreciated by one of ordinary skill in the art, these crimp grooves are permanent grooves comprising two chambers and a flat surface on top. While any configuration is deemed within the scope of the present invention, the presently preferred configuration depicted in the Figures shows a first crimp groove of the standard "D3" size, and the second crimp groove is a "BG" type. Other configurations using the crimp grooves sized for operation as a cable cutter head or "o" groove.

The tips 112 of the jaws according to the depicted embodiment include die buttons 119 as commonly found on crimp jaws. The die buttons 119 are operatively associated with the rear crimp groove 115. As will be appreciated, the die buttons 119 include a head portions, a spring portion, and a nut portion, each separated by a respective neck portion. The die buttons 119 serve to allow releasable attachment of die members from a die set. For example, a desired "W" sized die member(s) may be selected from a "W" die set and secured in the second crimp groove(s) 115 via the die button(s) 119.

The jaws 110A, 110B are connected to one another by the use of a locking pin 130 that passes through internal bores disposed on internal hubs of the jaws back portion 113. Disposed in the internal bores is a sleeve or bushing 140 (see FIG. 3B). The sleeve not only holds the two jaw members 110A, 110B together, but also allows pivot pin 130 to slide on one continuous surface when installing the jaws, thereby providing easier installation. In other words, the pin 130 will not be held up or catch in the areas where the respective jaws meet which may be slightly offset or have gaps. Additional, the sleeve 140 keeps the jaw members 100A, 110B of the crimp head together for easier handling when the pivot pin 130 is removed as discussed below.

Figure 4:
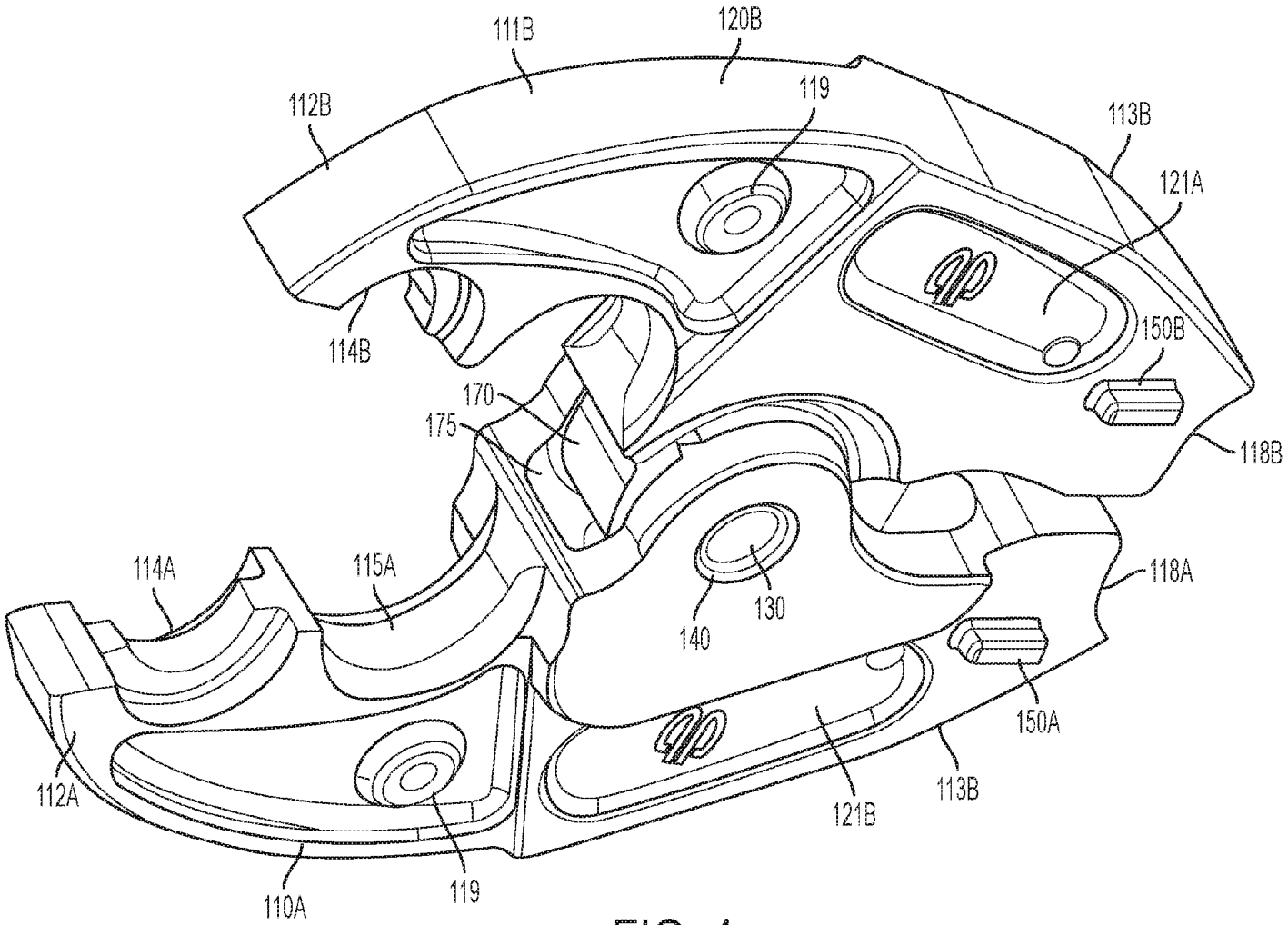
FIG. 4 is a perspective view of the jaws of an embodiment of the present invention shown in isolation.
Figure 5:
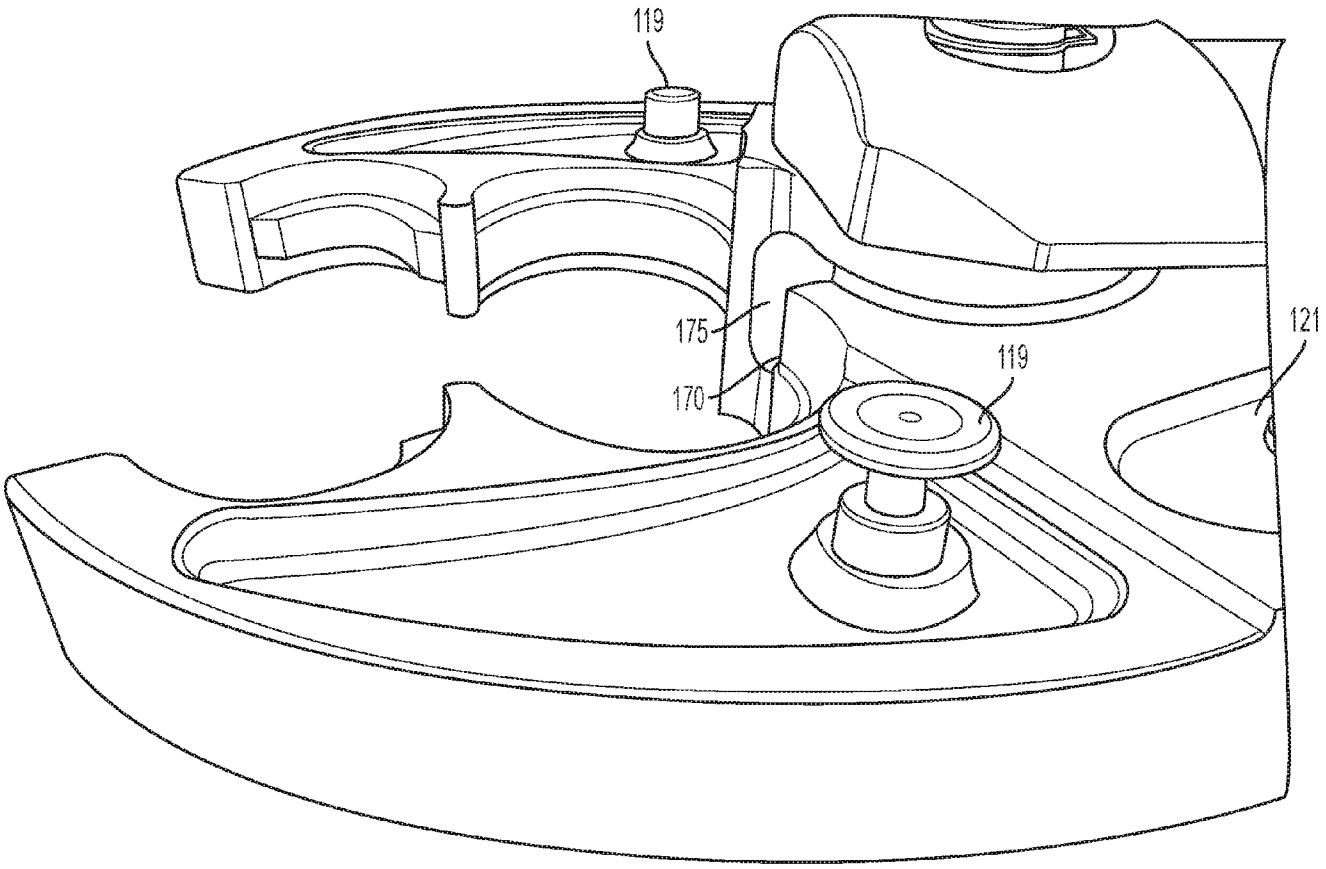
FIG. 5 is a perspective view of the jaws and neck of an embodiment of a crimp tool of the present invention.
Figure 6:
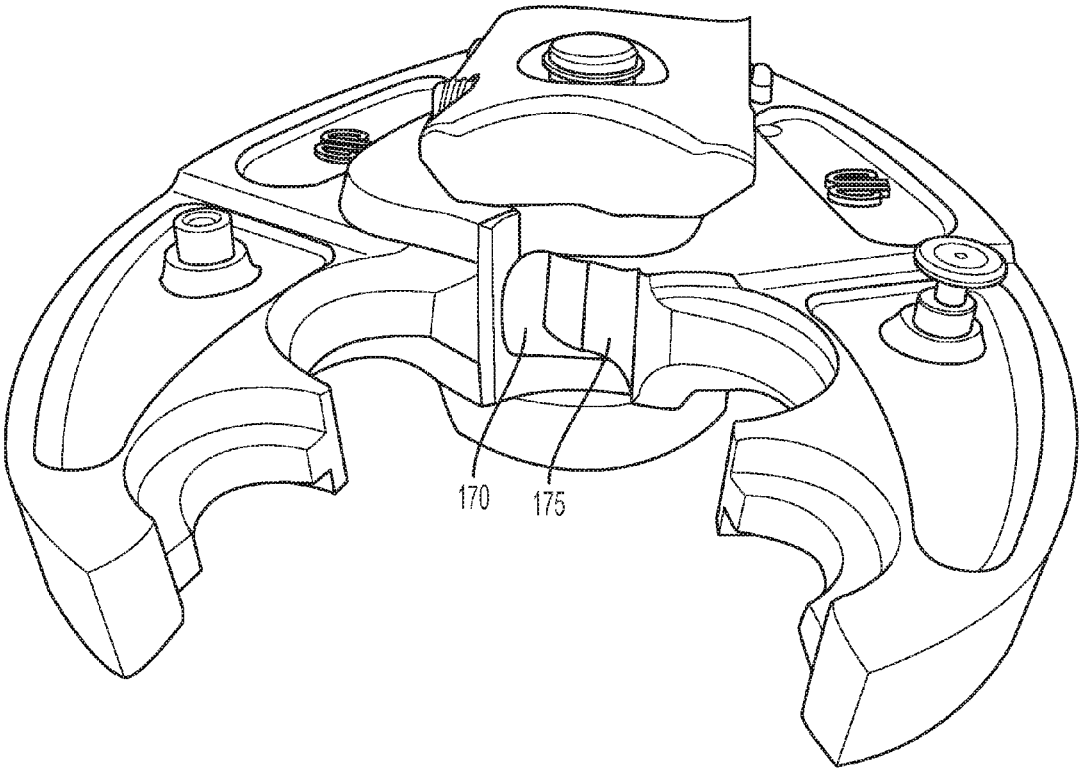
FIG. 6 is a front elevated perspective view of the jaws and neck of FIG. 5.

As best shown in FIGS. 4-6, the jaws 110A, 110B are configured to open and close relative to one another using a tongue-and-groove arrangement wherein the first jaw 110A includes a groove 175 that accepts a protruding tongue portion 170 of the interior area of the back portion 113B of the second jaw 110B. The tongue-and-groove arrangement allows the jaws 110A, 110B to pivot around pivot pin 130 and pivot open without the back ends 113A, 113B of the jaws 110A, 10B bumping into each other. The groove 175 provides a recess for the back "tongue" end 170 of the second jaw 110B to advance so the back ends 113A, 113B of the jaws 110A, 110B can be rotated towards and ultimately passed one another, providing clearance for the jaws to fully open.

Importantly, the tongue-and-groove configuration allows the section to keep the forces acting on the jaws symmetrical as well as reducing the stress, thereby allowing for a smaller, lighter weight design. Specifically, as will be appreciated by one of ordinary skill in the art, prior art jaws are designed as hermaphroditic pairs. As such, similar to a pair of ordinary scissors attempting to cut a piece of cardboard, the forces and tolerances lead to binding and bending and other problems from the asymmetric application of forces. With the tongue-and-groove configuration, all of the forces are symmetrically received. In addition, this configuration allows for tighter tolerances to further enhance performance of the mating jaws.

The lighter weight design is also achieved, at least in part, on some embodiments by the provision of one or more "pockets" 121A, 121B, or areas where the cross section is thinner in a desired shape. These pockets 121A, 121B not only serve as weight reduction pockets, but also are believed to be used in configuring jaws designed to absorb stress in a more uniform manner across the operative portions of the jaws. One of ordinary skill in the art armed with the present specification can design the pockets of any suitable size and shape depending on the material of construction and overall design of the jaws through routine experimentation in order to achieve one or more of the advantageous features of the weight reduction pockets.

Figure 7B:
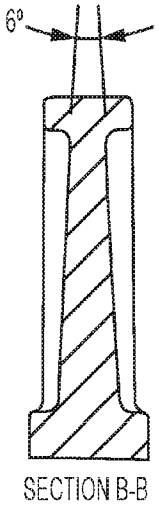
FIG. 7B is a cross sectional view of the jaws of FIG. 7A taken along line B-B.
Figure 7A:
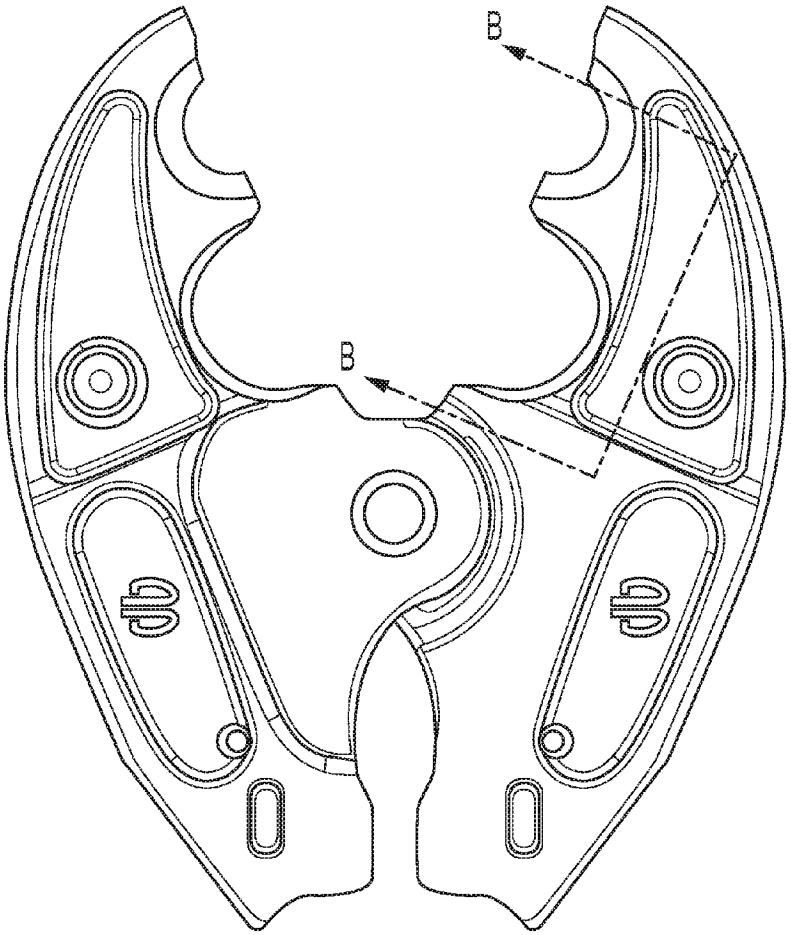
FIG. 7A is a side view of the jaws of an embodiment of the present invention.

In addition, as best shown in FIG. 7, a lighter weight design is achieved by tapering at least the tip portions 112A, 112B of the jaws 110A, 110B. In a presently preferred embodiment (see FIG. 7B), the tip portions 112A, B are tapered in a generally I-shaped configuration where the body tapers at an angle or preferably 6 degrees. The variable cross-section of the tip ends of the jaws reduces weight by only having material where it is needed. Additionally, as will be appreciated by one of ordinary skill in the art, the casting process is not only made easier by the tapered configuration, but also results in a superior product. Specifically, as will be appreciated, tapering the mold helps the flow of material for casting the jaws. The tapering allows the material to cool evenly from the edges inwardly, as opposed to cooling in patches in an untampered product. Without wishing to be bound by theory, the present inventor believes that tapering allows the flow rates and pressure of the process to be optimized to a point that the material does not start cooling before it spreads throughout the mold. This, in turn, facilitates the even cooling from the edges inward.

While a generally I-shaped configuration with 6 degree tapering is shown, one of ordinary skill in the art should appreciated that any suitable configuration that lessons the weight and/or eases manufacturing while not compromising strength should be understood to be within the scope of the invention. One of ordinary skill in the art should readily appreciate that during operation, the base of the jaw receives more stress so that area is preferably thicker. Tapering along the length of the operative area allows a jaw to be configured to ensure stress is more uniform across the jaw. One of ordinary skill in the art armed with the present application can configure a jaw with tapering and/or pockets through routine experimentation in a manner to achieve one or more of the advantageous features of receiving uniform stress and weight reduction based on the ultimate design and material of construction.

Figure 8A:
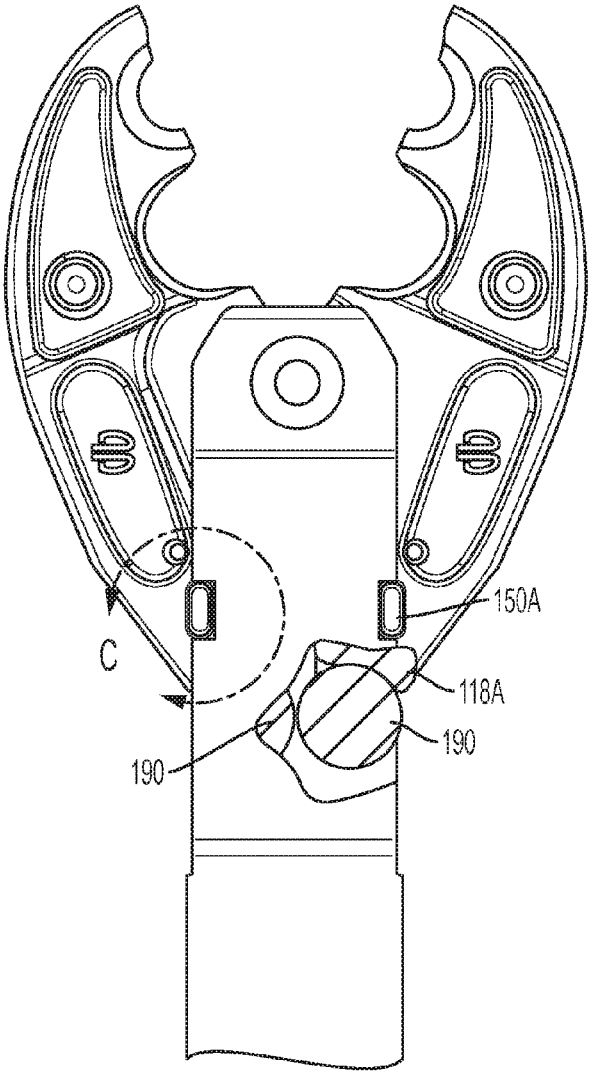
FIG. 8A is a side view in partial cross section of a neck and jaws of an embodiment of a crimp tool of the present invention.
Figure 8B:
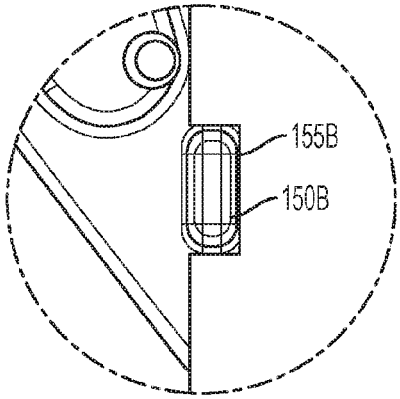
FIG. 8B is an enlarged view of the portion of FIG. 8A encircled by the dotted line C.
Figure 9A:
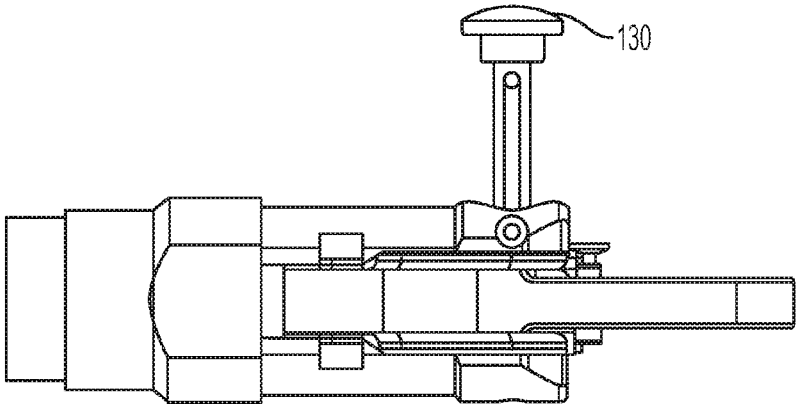
FIG. 9A is a top view of the jaws and neck of a crimp tool according to an embodiment of the invention receiving a locking pin.
Figure 9B:
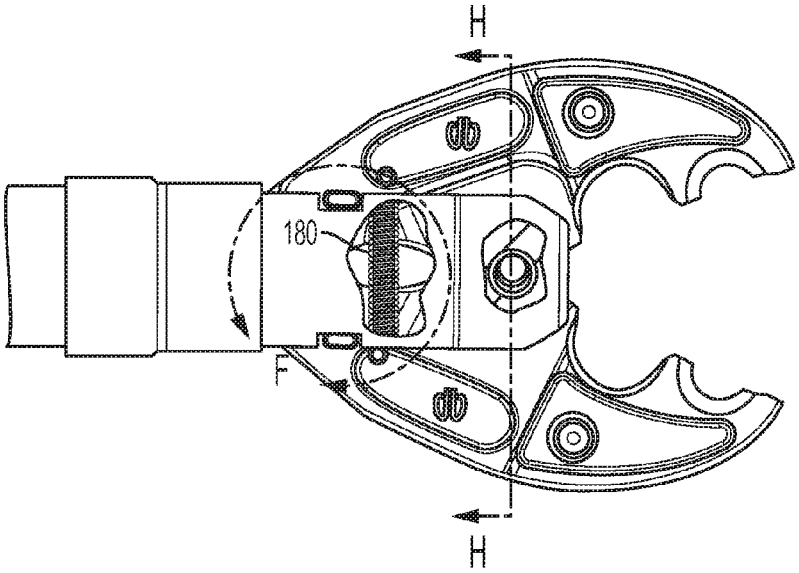
FIG. 9B is a sided view of the jaws and neck depicted in FIG. 9A
Figure 9C:
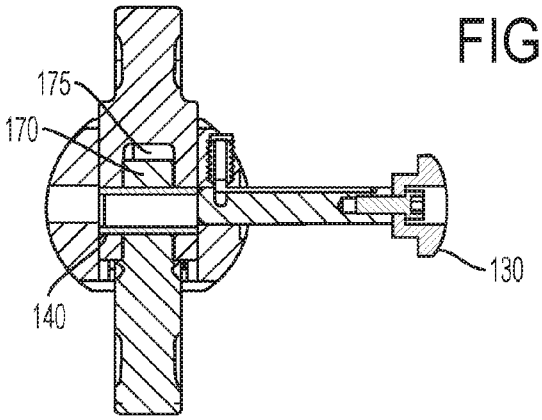
FIG. 9C is a cross-section of FIG. 9B taken along line H-H.
Figure 9D:
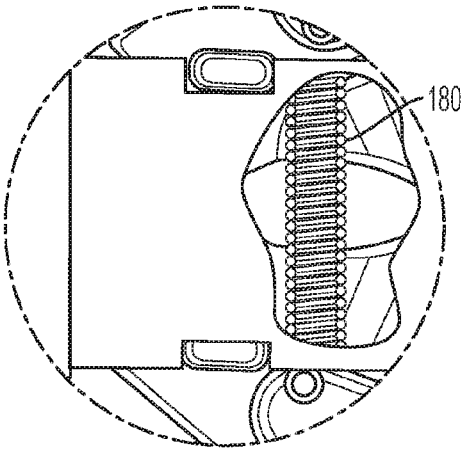
FIG. 9D is an enlarged view of the portion of FIG. 9B encircled by the dotted line F.
Figure 10:
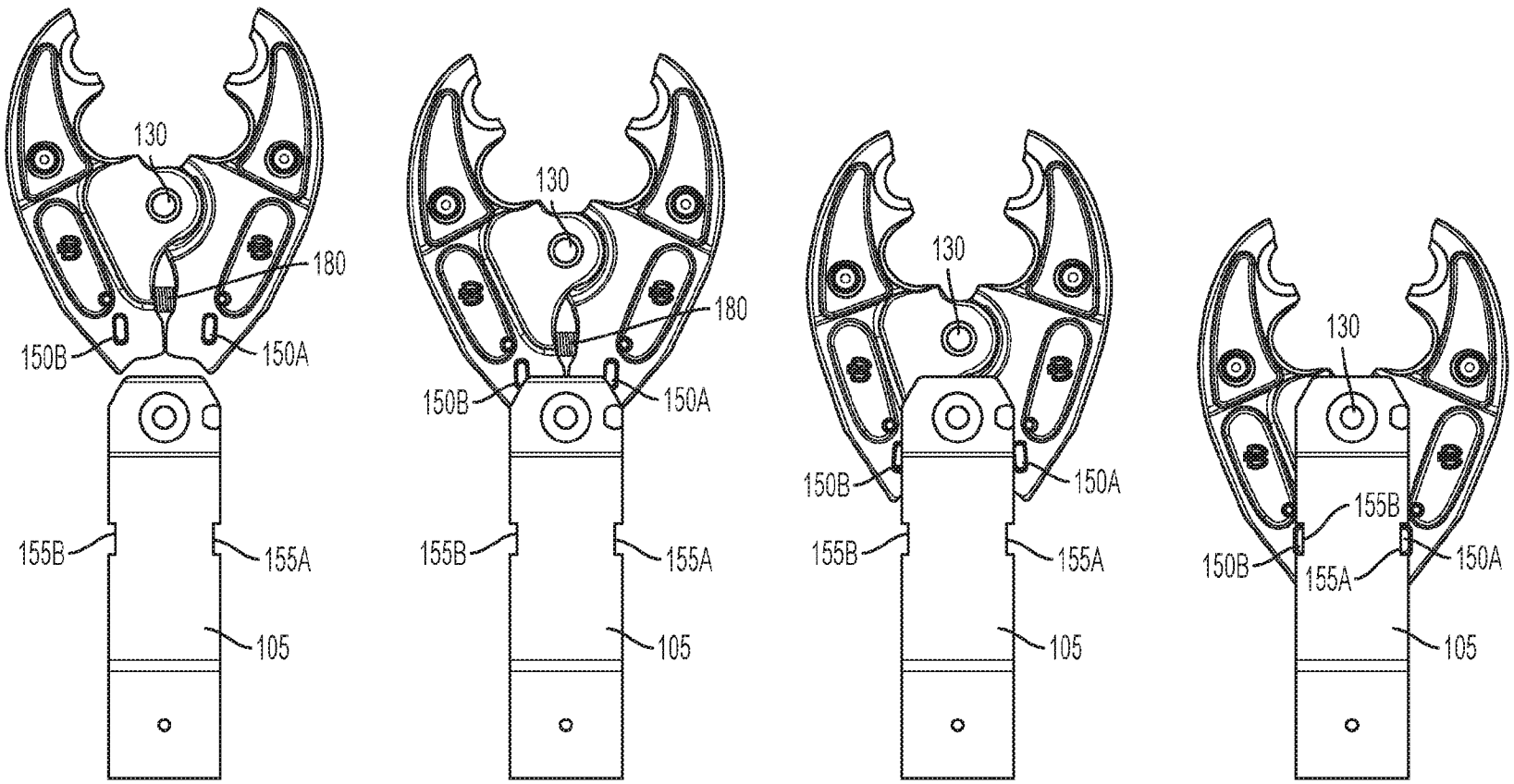
FIG. 10 is a side view of jaws of an embodiment of the invention opening after the locking pin is removed.

An additional advantageous feature of various embodiments of the invention is best shown in FIGS. 8-10. As discernable from the Figures, the back ends 113A, 113B of the jaws 110A, 110B include raised tabs 150A, 150B. These tabs 150A, 150B serve as stops providing multiple advantages. First, in some embodiments such as the one depicted, the respective stops 150A, 150B are preferably positioned to facilitate installation by allowing the jaws 110A, 110B to only open an amount that results in the pivot pin 130 being aligned with the inside of the sleeve 140. Thus, the problem of a user having to user their hand to hold the jaws in alignment is mitigated. A user can now allow the jaws to release and fall open as shown in FIGS. 8-10 leaving the jaws aligned.

Secondly, in some embodiments such as the one depicted, the tabs 150A, 150B are sized and configured to mate with a respective tab notch 155A, 155B provided on the neck (yoke) 105 of the tool 100. Preferably, when the tabs 150A, 150B fit into their respective notches 155A, 155B they align the pivot hole with the jaw release pin and a also allow the roller 190 (see FIG. 8B) to come in contact with the cam surfaces 118A, 118B of the jaws 110A, 110B. Again, the alignment mitigates a common problem with prior art tools.

In addition, an added benefit is that when the tabs 150A, 150B lock into their respective tab notches 155A, 155A, the jaws 11A, 11B are preventing from falling out of the tool 100 when the locking pin 130 is removed. Additionally, when the locking pin 130 is pulled, the jaw members 110A, 110B not only remain in the tool 100, but also spring tension from spring member 180 (see FIGS. 9B, D) on the back ends 113A, 113B of the jaws 110A, 110B, the two tabs 150A, 150B are held securely in the notches 155A, 155B. As will be appreciated, spring member 180 biases the jaws. Opposite ends of the spring are connected to opposing jaw members by connections accessed through spring pin holes 181A, 181B.

Furthermore, as best shown in FIG. 10, even if the pin 130 is removed, since the sleeve 140 is present, the two jaw members 11A, 11B are held together. The jaws 11A, 11B may move slightly, but once the tabs 150A, 150B lock into their notches 155A, 155B, the jaws 11A, 11B are held in place. As will be appreciated by one of ordinary skill in the art armed with the present specification, user frustration from the unlocking of the jaws and them falling off the tool is a common problem that is overcome by one or more of the above described embodiments utilizing tab members.

Various embodiments of the present invention, such as the presently preferred embodiment depicted in the Figures, lend themselves to the provision of additional advantageous features. For example, the tool 100 may make use of a trigger lock 106 for added safety. The trigger lock would preferably require release for every crimping operation. Similarly, the tool 100 could use a planetary gear box 107 that would provide lower ratio/less torque and tangential forces which results in the need for fewer bearings.

A presently preferred embodiment of a hydraulic tool 100 exemplifying various features of the invention also includes the feature of a ball bearing 200 being disposed between the interface 250 of the pump 30*o* and the wobble plate 400. The operation and interaction of the pump 300 and wobble plate 400 in prior art hydraulic tools is well understood in the art and the details of which will not be discussed herein. The presently preferred embodiment modifies the prior art structure. As shown in FIGS. 11-14, the pumps 300 are spaced 0.800" apart in the hydraulic pump body (not shown), and likewise, the spherical pockets 450 in the wobble plate 400 are also machined 0.800" apart. However, since the wobble plate 400 is always constrained at an angle (4 degrees), at certain points in the rotation, the effective distance between the two spherical cutouts is less than the 0.800" pump distance. As will be appreciated by one of ordinary skill in the art, if the pump was directly contacting the wobble plate 400, this would cause a sliding motion in that interface.

Figure 14:
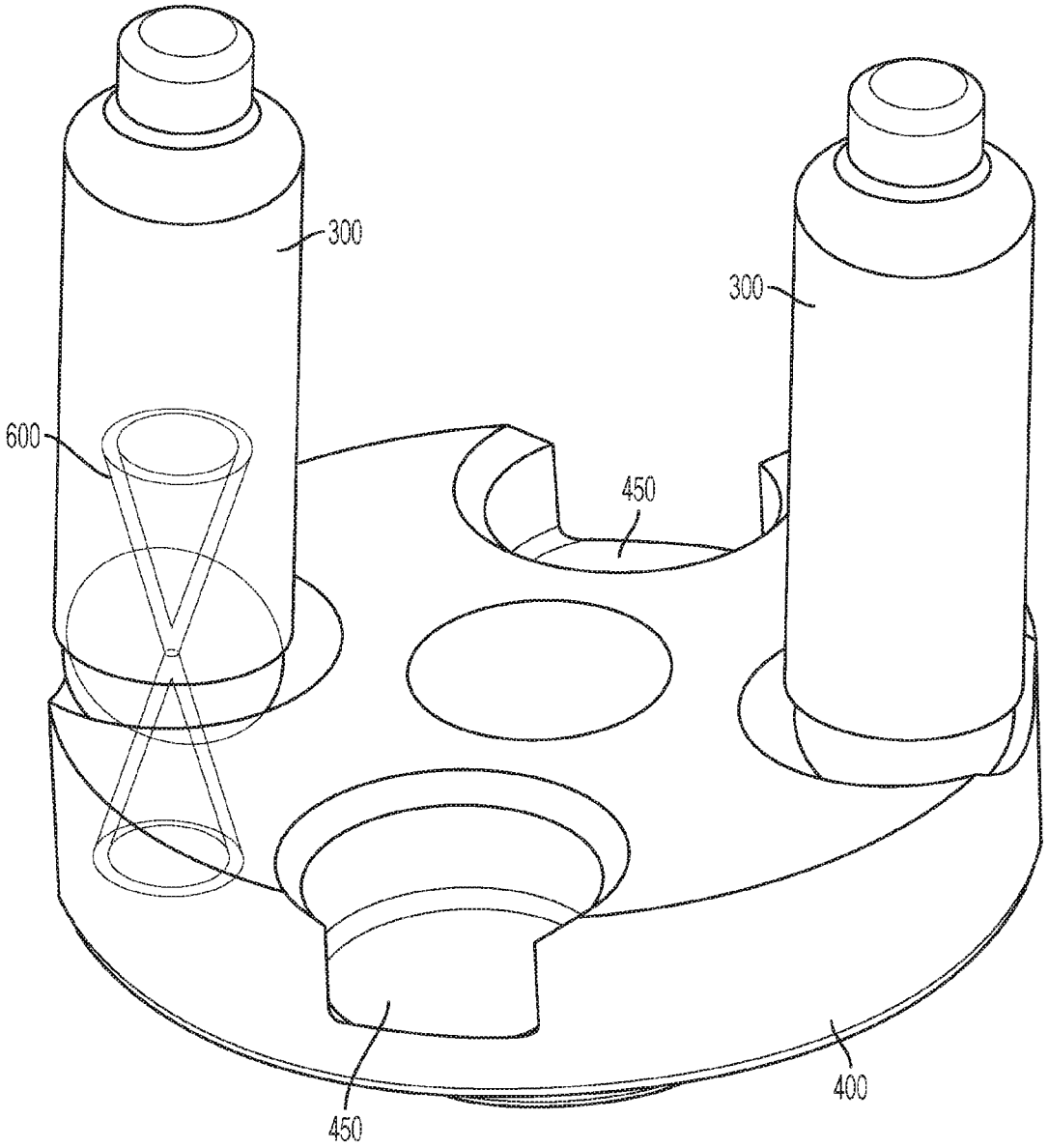
FIG. 14 is a perspective view of a wobble plate assembly according to an embodiment of the invention.

As will be appreciated by one of ordinary skill in the art armed with the present specification, when a ball bearing 200 is placed between each of the pumps 30*o* and the wobble plate 400, one more degree of freedom is created and the ball 200 creates a rolling contact, which greatly improves the efficiency, especially at high rotational speed. As shown in the Figures, there are two contact points 650A, 650B, and as the wobble plate 400 moves through its cycle, the "axis" 500 changes in a conical pattern 600 (see FIG. 14 depicting the conical pattern for illustrative purposes). The end result of this configuration is an improved and more efficient tool.

The foregoing embodiments and advantages are merely exemplary and are not to be construed as limiting the scope of the present invention. The description of an exemplary embodiment of the present invention is intended to be illustrative, and not to limit the scope of the present invention. Various modification, alternatives and variations will be apparent to those of ordinary skill in the art, and are intended to fall within the scope of the invention.

What is claimed is:

1. A jaw member assembly for a crimp tool comprising:
a first jaw member having a front end and a back end, said front end defining a crimp area and said back end defining a groove and a bore;
a second jaw member having a front end and a back end, said front end defining a crimp area and said back end having a tongue portion sized for receipt in said groove of said first jaw member and a bore;
said respective bores being alignable when said first jaw member and said second jaw members are connected in a tongue-in-groove arrangement;
a spring member having a first end attached to said first jaw member and a second end attached to said second jaw member;
a locking pin extending through said first and second bore when said bores are aligned; and
a tool neck for receiving said jaw members, and said jaw members including respective locking tabs on an outside edge of said jaw member.

2. The jaw member assembly of claim 1, further comprising:
a bushing inserted in and coterminous with the aligned bore members of said first and second jaw members.

3. The jaw member assembly of claim 1, wherein said front ends of said jaw members are tapered from back to front.

4. The jaw member assembly of claim 3, wherein said front ends are tapered at 6 degrees.

5. The jaw member assembly of claim 1, wherein said tool neck includes a pair of tab notches, wherein said tool jaws rotate away from one another until the respective locking tab of each jaw member enters its respect tab notch.

6. The jaw member assembly of claim 1, wherein each of said jaw members includes a recessed pocket area.

7. The jaw member assembly of claim 6, wherein a pocket area is disposed on said back ends of said jaw members.

8. A jaw member assembly for a crimp tool comprising:
a first jaw member having a front end and a back end, said front end defining a crimp area and said back end defining a bore;
a second jaw member having a front end and a back end, said front end defining a crimp area and said back end defining a bore;
said respective bore opening members being aligned and a locking pin extending through said bores to hold said jaw members in cooperative engagement;
a spring member having a first end attached to said first jaw member and a second end attached to said second jaw member; and
said front end of said jaw members being formed in a generally I-shaped shaped configuration.

9. The jaw member assembly of claim 8, further comprising:
a bushing inserted in and coterminous with the aligned bore members of said first and second jaw members.

10. The jaw member assembly of claim 9, wherein said I-shaped configuration is tapered along its length approximately 6 degrees.

11. The jaw member assembly of claim 9, further comprising a tool neck for receiving said jaw members, and said jaw members including respective locking tabs on an outside edge of said jaw member.

12. The jaw member assembly of claim 11, wherein said tool neck includes a pair of tab notches, wherein said tool jaws rotate away from one another until the respective locking tab of each jaw member enters its respect tab notch.

13. A battery-powered crimp tool comprising:
a battery pack;
a handle portion;
a gear box disposed in said handle portion;
a control switch disposed on said handle portion and operatively engaged to said gear box;
a neck portion driven by said gear box;
a tool head connected to said neck portion, said tool head comprising first and second jaw members, said first jaw member having a front end and a back end, said front end defining a crimp area and said back end defining a first bore;
said second jaw member having a front end and a back end, said front end defining a crimp area and said back end defining second bore;
said first and second bores being selectively alignable when said first jaw member and said second jaw members are connected;
a spring member having a first end attached to said first jaw member and a second end attached to said second jaw member;
a locking pin extending through said first and second bore when said bores are aligned;
wherein when said control switch is in a first position the jaw members are in a first non-crimp position and when said switch is moved to a second position said gear box provides force to a roller on said neck portion to rotate said jaw members together in a second crimp position;
a first locking tab disposed on an outside edge of said first jaw member, and a second locking tab disposed on an outside edge of said second jaw member, a first locking tab notch on a first side of said neck portion and a second locking tab notch on a second side of said neck portion opposite said first side, wherein when said locking pin is removed from said bore, said first and second jaw members rotate apart and descend until said respective locking tabs mate with a respective locking notch and are prevented from falling off the neck of the tool.

14. The crimp tool of claim 13, wherein said front ends of said jaw members are tapered from back to front.

15. The crimp tool of claim 14, wherein said front ends are tapered at 6 degrees.

16. The crimp tool of claim 13, wherein said first jaw member defines a groove opening and said second jaw member includes a tongue extension, wherein said first and second jaw members are connectable in a tongue-in-groove arrangement.

17. The crimp tool of claim 16, further comprising a bushing extending through said first and second bore openings when said jaw members are connected.

18. The crimp tool of claim 13, further comprising a pump, a wobble plate, and a ball bearing disposed at an interface between the pump and the wobble plate, wherein in operation as said wobble plate moves through its cycle an axis of said wobble plate changes in a conical pattern.

19. The crimp tool of claim 13, wherein each of said jaw members include pocket areas where the cross section of the jaw is thinner than the cross section of the area surrounding the pockets, said pocket areas having a cross sectional thickness that tapers towards said front end of said jaw members.

* * * * *